US008528112B2

(12) United States Patent
Blauer et al.

(10) Patent No.: US 8,528,112 B2
(45) Date of Patent: Sep. 10, 2013

(54) BALLISTIC VEST CARRIER COVER SYSTEM

(75) Inventors: Stephen J Blauer, Lexington, MA (US); Robert K Lee, Cranston, RI (US)

(73) Assignee: Blauer Manufacturing Company, Inc., Boston, MA (US)

( * ) Notice: Subject to any disclaimer, the term of this patent is extended or adjusted under 35 U.S.C. 154(b) by 0 days.

(21) Appl. No.: 13/367,262

(22) Filed: Feb. 6, 2012

(65) Prior Publication Data

US 2012/0124713 A1 May 24, 2012

Related U.S. Application Data

(60) Provisional application No. 61/473,237, filed on Apr. 8, 2011, provisional application No. 61/561,858, filed on Nov. 19, 2011.

(51) Int. Cl.
*F41H 1/02* (2006.01)

(52) U.S. Cl.
USPC ..... 2/2.5; 2/92; 2/102

(58) Field of Classification Search
USPC ..... 2/2.5, 92, 102, 94, 113, 103, 114, 2/80, 267, 95, 250, 251, 456, 458, 2.16, 462–467, 2/97; 89/36.05
See application file for complete search history.

(56) References Cited

U.S. PATENT DOCUMENTS

| | | | | |
|---|---|---|---|---|
| 4,266,297 | A * | 5/1981 | Atkins | 2/2.5 |
| 4,485,491 | A * | 12/1984 | Rasmussen | 2/2.5 |
| 5,157,792 | A | 10/1992 | Allen et al. | |
| 5,331,683 | A | 7/1994 | Stone et al. | |
| 6,066,017 | A * | 5/2000 | Max et al. | 441/98 |
| 6,526,862 | B1 * | 3/2003 | Lyons | 89/36.05 |
| 2001/0050492 | A1 * | 12/2001 | Janevski | 296/39.1 |
| 2006/0037121 | A1 | 2/2006 | Park | |
| 2008/0263737 | A1 | 10/2008 | Parks et al. | |

FOREIGN PATENT DOCUMENTS

EP 1772697 A2 4/2007

OTHER PUBLICATIONS

American Body Armor, Uniform Carrier, 2009.
Point Blank Armor, Tailored Armor Carrier, 2010.

* cited by examiner

*Primary Examiner* — Danny Worrell
*Assistant Examiner* — Khaled Annis
(74) *Attorney, Agent, or Firm* — Altman & Martin; Steven K Martin

(57) ABSTRACT

A ballistic vest carrier cover has a mantle that goes over the wearer's shoulders from the front waist to rear waist. It has a fabric outer layer, an interlining heat-fused to the back of the outer layer, and a liner. The cover is designed to fit over a pullover shirt so the combination appears as a standard uniform shirt. The liner attaches to the outer layer at the front and rear waist, neck, and along the sides from front armor openings to rear armor openings, thereby producing front and rear pockets for receiving the body armor panel carriers through the armor openings. The front of the mantle attaches to the rear at the waist by zippers. One zipper component is on a stretch panel that extends from the outer layer at the rear armor opening and the other zipper component is on the outer layer at the front armor opening.

21 Claims, 8 Drawing Sheets

BALLISTIC VEST CARRIER COVER SYSTEM

CROSS-REFERENCES TO RELATED APPLICATIONS

The present application claims the benefit of and priority to U.S. Provisional Patent Application No. 61/473,237, filed on Apr. 8, 2011 for BALLISTIC VEST CARRIER SYSTEM AND SYSTEM FOR SUSPENDING A DUTY BELT FROM THE WEARER'S SHOULDERS in the names of Stephen J. Blauer and Robert K. Lee, hereby incorporated by reference in its entirety, and to U.S. Provisional Patent Application No. 61/561,858, filed on Nov. 19, 2011 for BALLISTIC VEST CARRIER COVER SYSTEM AND SYSTEM FOR SUSPENDING A DUTY BELT FROM THE WEARER'S SHOULDERS in the names of Stephen J. Blauer and Robert K. Lee, hereby incorporated by reference in its entirety.

STATEMENT REGARDING FEDERALLY SPONSORED RESEARCH OR DEVELOPMENT

Not Applicable

REFERENCE TO A SEQUENCE LISTING, A TABLE, OR A COMPUTER PROGRAM LISTING COMPACT DISK APPENDIX

Not Applicable

BACKGROUND OF THE INVENTION

1. Field of the Invention

The present invention relates to police equipment, more particularly, to outer carrier wearing of soft body armor, law enforcement duty belts and methods for suspending them.

2. Description of the Related Art

Standard equipment for peace officers includes the wearing of an undershirt or turtleneck, a ballistic soft body armor vest, and a police uniform shirt over the vest. The body armor vest includes a carrier, two armor panels, and attachable/detachable fasteners, typically hook and loop fasteners. One armor panel fits into a front carrier through an opening in the bottom of the front carrier and the other armor panel fits into a rear carrier through an opening in the bottom of the rear carrier. The attachable/detachable fasteners attach the front and rear carriers together around the wearer's waist and over the shoulders to form the vest.

The body armor vest traps excess body heat around the torso in warm weather and is uncomfortable due to the constant compression and weight of the armor. It is also very inconvenient to remove the body armor carrier prior to the conclusion of the wearer's shift. For this reason there has been a move towards the wearing of outer carrier ballistic vests.

Most outer carrier vests are made from heavy-duty nylon or polyester materials and are fitted to a particular brand of soft body armor panels. The panels are removed from the front and rear carriers and inserted into the bottom of the carrier vest. The carrier vest has attachable/detachable, Typically hook and loop, fasteners at the sides for adjustment and removal. Use of the carrier vest's fasteners rather than those supplied by the manufacturer with the body armor panels may void the armor warranty. The carrier vests are made to somewhat match the look of a uniform shirt on the outside and are typically worn over a police shirt. The carrier vest is independent from the duty belt and sits above it on the torso.

An officer wears a duty belt on his or her waist, which supports heavy gear such as a pistol, cartridges, radio, less than lethal weapons, handcuffs, flashlight, defensive spray, and baton. The weight of the duty belt and the gear supported thereon, which can exceed 25 pounds, is carried on the hips, waist, and lower back of the officer. After years of wear, many officers experience severe back problems as a result of wearing the heavy duty belt.

Current solutions transfer some of the weight of the belt and equipment to the shoulders, removing it from the hips and low back. One solution is the use of suspenders to support the duty belt. However, suspenders detract from the appearance of the officer's uniform. Also, they can be grabbed and held by a person to gain an unfair leverage or advantage over the officer during the fight or scuffle. In an extreme case they could be used to strangle the officer.

Another solution is to store equipment on the outer carrier vest. However, this detracts from the appearance of the uniform since most outer carrier vests make poor-looking shirts. It is also so obvious that the officer is wearing an outer carrier vest that criminals have been known to aim for the groin or head when assaulting an officer.

Also, when equipment is stored on the carrier vest, the vest cannot be removed without making provisions for storing the equipment. In a scuffle, the vest can come apart at the waist, allowing the combatant to easily remove equipment from the free hanging carrier vest. The equipment on the carrier vest may also interfere with the proper use of seatbelts in the patrol car and any equipment worn on a carrier vest could be impacted by the vehicle's airbag in a crash.

Yet another solution is to store equipment on a harness worn over the uniform shirt. Again, the harness detracts from the appearance of the uniform and can be grabbed and held by a person to gain an unfair leverage or advantage over the officer during the fight or scuffle. If the harness attaches with hook and loop fasteners, it can also be removed relatively easily from the officer in a fight.

BRIEF SUMMARY OF THE INVENTION

The present specification describes two inventions, a ballistic vest carrier cover and a duty belt suspension system.

The ballistic vest carrier cover has a mantle that goes over the wearer's shoulders from the front waist to rear waist and with a neck opening. The mantle has a front panel and rear panel that are composed of a fabric outer layer, an optional interlining, and a liner.

The carrier cover is designed to fit over a long-sleeve pullover shirt such that, from a distance, the combination of carrier cover and pullover shirt appear as a standard uniform shirt. To that end, the outer layer is composed of a standard uniform shirt fabric of the appropriate color and can optionally include one or more of a number of typical uniform shirt accoutrements. The optional interlining has a thermoplastic adhesive to heat-fuse the interlining to the back of the outer layer.

The liner is attached to the outer layer at the front and rear waist, the neck opening, and along the sides from a front armor opening to a rear armor opening. Because the outer layer and liner are only attached at the edges, a front pocket and a rear pocket are formed between the outer layer and liner for receiving the body armor panel carriers. The armor openings on the sides above the waist attachments provide access to the pockets for installing and removing the armor panel carriers. The openings on both sides of the cover permit the use of armor panel carriers that extend around the sides by allowing the armor panel carriers to extend out of the pockets through the openings. The body armor waist straps supplied with the body armor can be used for individual adjustment.

Openings in the liner at the shoulders facilitate attaching the two armor panel carriers together at the shoulders using the body armor shoulder straps supplied with body armor through tunnels that connect the front and rear pockets.

The front panel removably attaches to the rear panel by zippers that are, optionally, double-ended. One zipper component is attached to a stretch panel that extends from the outer layer at the rear armor opening. The other zipper component is attached to the outer layer at the front armor opening. The stretch panels help hide the body armor panel carriers and straps outside of the pockets, thereby facilitating the illusion of a standard uniform shirt.

The duty belt suspension system is a removable attachment that attaches a duty belt to an outer ballistic vest or cover in order to transfer much of the weight of the belt onto the wearer's shoulders. The attachment includes one or more fasteners. One component of the fastener is attached to the vest and the other component is attached to the belt. In one embodiment, the vest components of the fasteners are attached directly to the vest and, in other embodiments, the vest components are attached to the ends of a pair of straps. The straps extend up the inside of the front of the vest, over the shoulder, and down the inside of the rear of the vest. The ends extend to approximately the bottom edges of the front and rear of the vest. In one configuration, the straps are held in place in the vest permanently. In another configuration, the straps held in place by horizontal bands attached to the inside of the vest.

The present invention contemplates many different configurations of vest/belt attachment, including various combinations of one or two rings and a spring clip, side release buckles, front release buckles, and hook and loop fasteners.

Objects of the present invention will become apparent in light of the following drawings and detailed description of the invention.

BRIEF DESCRIPTION OF THE DRAWINGS

For a fuller understanding of the nature and object of the present invention, reference is made to the accompanying drawings, wherein.

DETAILED DESCRIPTION OF THE INVENTION

A. Ballistic Vest Carrier Cover

One invention described herein is a ballistic vest carrier cover 10, shown in FIGS. 1-8. The cover is unique, in part, because it is the only system that uses the entire carrier, armor panel, and fastening system of the original concealed soft body armor.

Figure 1:
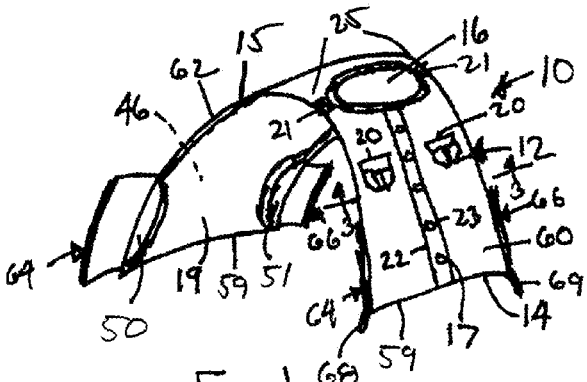
FIG. 1 is a perspective view of the ballistic vest carrier cover of the present invention.
Figure 2:
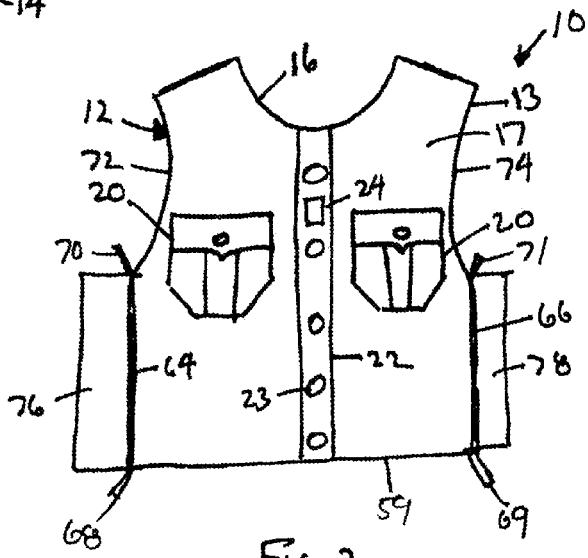
FIG. 2 is a front view of the carrier cover of FIG. 1 showing several options.
Figure 3:
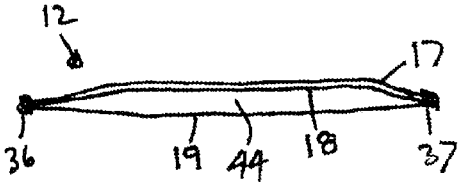
FIG. 3 is a cross-sectional view of one fabric structure of the carrier cover of FIG. 1 on the line 3-3.

The ballistic vest carrier cover 10 has a mantle 12 that goes over the wearer's shoulders from the front waist to rear waist and with a neck opening 16 that goes over the head. In one configuration, the mantle 12 is a single panel, as in FIG. 2. In another configuration, the mantle 12 is composed of a front panel and a rear panel that are attached at the shoulder 25, as in FIG. 1. The mantle 12 has a fabric outer layer 17, an optional interlining 18, and a liner 19, as shown in FIG. 3.

Figure 4:
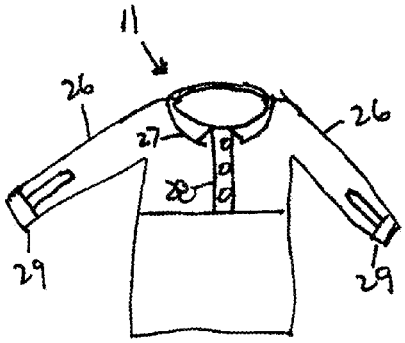
FIG. 4 is a perspective view of a long-sleeve pullover shirt for use with the carrier cover of the present invention.

The carrier cover 10 is designed to fit over a pullover shirt 11 with color-matched short or long sleeves 26, a collar 27, an optional false placket 28, and optional cuffs 29, as shown in FIG. 4. From a distance and at first glance, the combination of carrier cover 10 and pullover shirt 11 are intended to appear as a standard uniform shirt. The combination preserves the officers tactical advantage gained by wearing "concealed" armor that is more comfortable to wear versus most outer carriers which do not match the shirts they are worn over.

To that end, the outer layer 17 is composed of a standard uniform shirt fabric of the appropriate color. The outer layer 17 can optionally include one or more of plain or pleated breast pockets 20, a false placket 22 with buttons 23, a shoulder yoke, shoulder epaulets 21, front and/or rear creases, microphone tab 24, and any other items that may be found on a uniform shirt. The shirt fabric can be woven or knit fabrics or uniform shirt fabrics such as all wool or polyester, nylon, poly cotton, poly rayon, poly wool, waterproof barriers, or fire-retardant fabric combinations.

Figure 5:
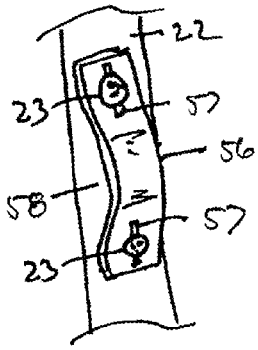
FIG. 5 is a detailed view of the tie clip strip.

Because a tie cannot be clipped to the false placket 22, the carrier cover 10 optionally includes a tie clip strip 56 with button holes 57, as shown in FIG. 5. The strip 56 extends between two adjacent buttons 23 on the false placket 22, where the buttons 23 extend through the button holes 57. The strip 56 provides a space 58 for securing a tie clip.

The optional interlining 18 has a thermoplastic adhesive that is activated by pressing or fusing machine rollers to heat-fuse the interlining 18 to the back of the outer layer 17. Typically, the interlining 18 is a lightweight tricot, woven or unwoven. The interlining 18 protects the outer layer 17 from abrasion from the body armor panel carriers 40, 42, thereby providing strength and durability to the carrier 10. It also improves the appearance of the carrier 10 by providing stability to the outer layer 17.

The liner 19 is composed of a knit or woven material, either polyester, nylon, or a combination of synthetic and natural fibers. The liner 19 may be wicking or non-wicking in performance. The liner 19 may be a stretch or non-stretch material. In the present embodiment, the central majority 30 of the liner 19 is a heavyweight polyester mesh, and strips 31, 32 that make up approximately 2-3 inches of the lower ends are nylon or polyester. The mesh 30 and strips 31, 32 are attached to each other in whatever manner is appropriate for the materials.

Figure 6:
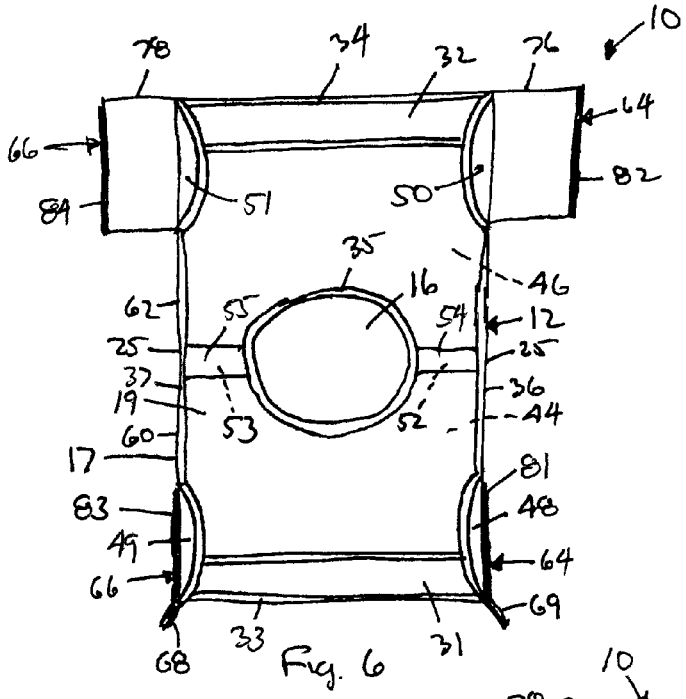
FIG. 6 is a view of the inside of the carrier cover of FIG. 1.

The liner 19 is attached to the outer layer 17 at several places, as shown in FIG. 6. The layers 17, 19 are attached at the front waist, as at 33, at the rear waist, as at 34, at the neck opening 16, as at 35, along the right side from a right front armor opening 48 adjacent to the front waist 33 to right rear armor opening 50 adjacent to the rear waist 34, as at 36, and along the left side from a left front armor opening 49 adjacent to the front waist 33 to left rear armor opening 51 adjacent to the rear waist 34, as at 37. The front armor openings 48, 49 are separated by the front waist attachment 33, and the rear armor openings 50, 51 are separated by the rear waist attachment 34. The attachments 33-37 can be stitched and reinforced with durable fabrics, such as polyester or nylon, to prevent abrasion and wear. Optionally, the waist attachments 33, 34 can be by zippers or hook and loop fasteners to allow armor panel carriers 40, 42 to be inserted from the bottom.

Figure 7:
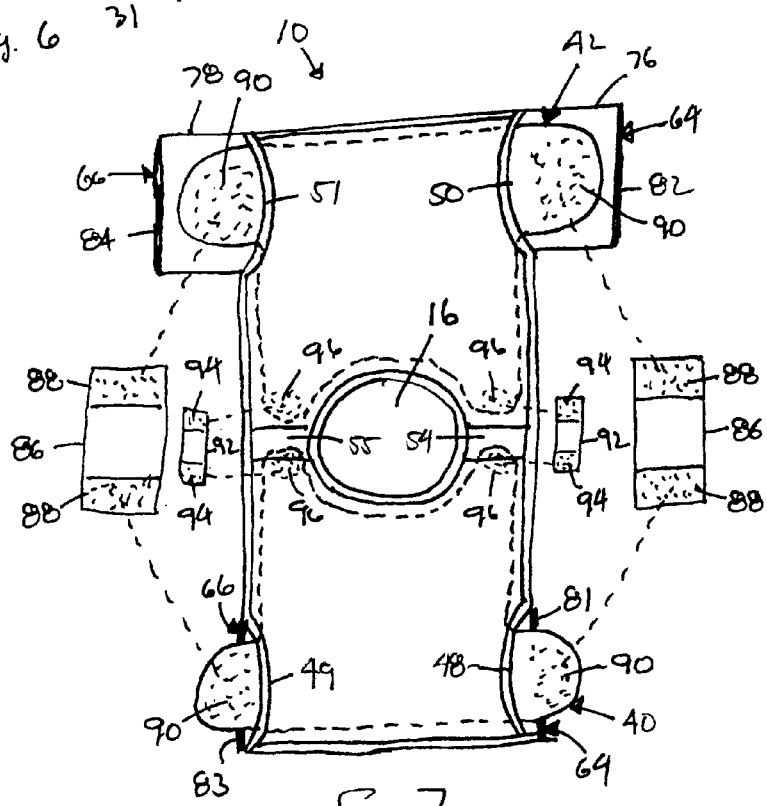
FIG. 7 is a view of the inside of the carrier cover of FIG. 1 with body armor carriers installed.
Figure 8:
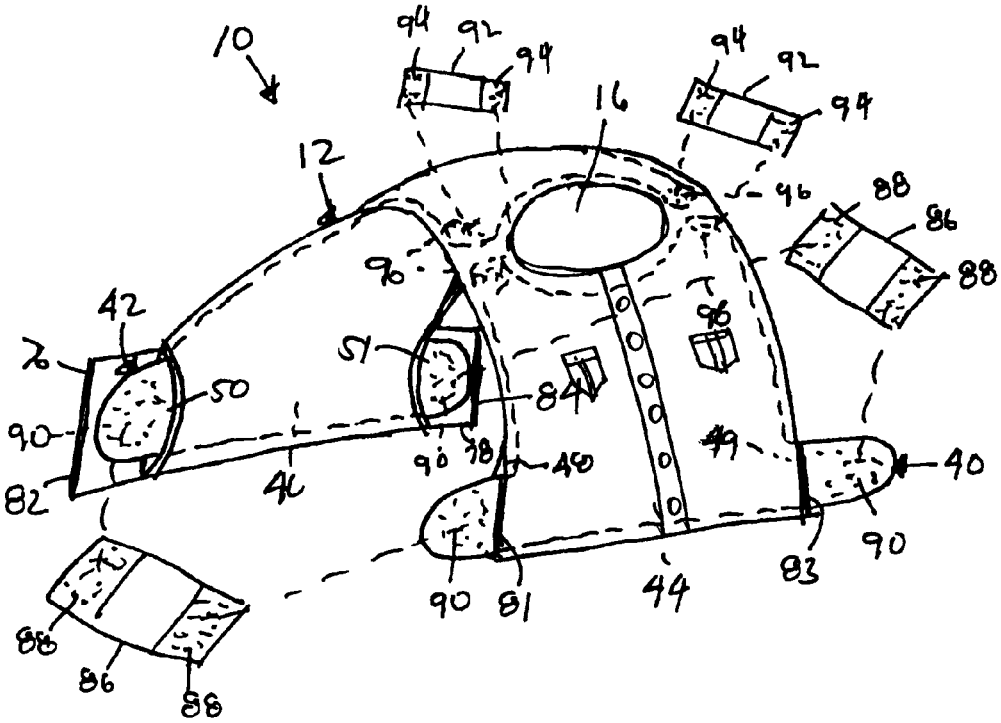
FIG. 8 is a perspective view of the carrier cover of FIG. 1 with body armor carriers installed.

Because the outer layer 17 and liner 19 are only attached at the edges, two pockets are formed, a front pocket 44 and a rear pocket 46, between the outer layer 17 and liner 19 for receiving the body armor panel carriers 40, 42, as shown in FIGS. 7 and 8. Openings 48-51 between the waist attachments 33, 34 and the ends of the side attachments 36, 37 provide access to the pockets 44, 46 for installing and removing the armor panel carriers 40, 42.

In one configuration, the carrier cover 10 is designed to accept most available concealed body armor carriers with their armor panels installed. Having openings 48-51 on both sides permits the use of armor panel carriers 40, 42 that have full wrap around side coverage (so called "full coverage" armor systems) by allowing the armor panel carriers 40, 42 to extend out of the pockets 44, 46 through the openings 48-51. The armor panel carriers 40, 42 can overlap by as much as two inches at the sides to, in part, alleviate pinching of the wearer between the panel carriers 40, 42 that can sometimes occur.

The openings 48-51 allow the use of the body armor waist straps 86 that are supplied with the body armor for individual adjustment. The waist straps 86 are typically elastic and about four to six inches wide, with a component of a hook and loop fastener 88 on each end. Each waist strap fastener 88 attaches to a mating hook and loop fastener 90 on the body armor panel carrier 40, 42, while extending around the wearer's side.

The carrier cover 10 is designed with tunnels 52, 53 at each shoulder between the front pocket 44 and the rear pocket 46 to allow fastening of the front and rear armor panel carriers 40, 42. Openings 54, 55 in the liner 19 at the shoulders 25 facilitate attaching the two armor panel carriers 40, 42 together at the shoulders 25 using the body armor shoulder straps 92 supplied with body armor. The shoulder straps 92 are typically elastic and about two inches wide, with a component of a hook and loop fastener 94 on each end. Each shoulder strap fastener 92 attaches to a mating hook and loop fastener 96 on the body armor panel carriers 40, 42, while extending over the wearer's shoulder.

In another configuration, the carrier cover 10 is designed to accommodate only armor panels of a particular shape. Typically, in such a case, only one opening 48, 50 is needed for each pocket 44, 46.

The front panel 60 removably attaches to the rear panel 62 by zippers 64, 66 that extend from the waist 59 upwardly to create arm holes 72, 74. The zippers 64, 66 are typically up to six inches long and have a front component 81, 83 and a rear component 82, 84. Optionally, a thin fly covers each zipper 64, 66. Zippers help prevent twisting or turning or opening of the carrier and carrier cover 10 in a scuffle and pulled over the wearer's head.

Optionally, the zippers 64, 66 are double-ended, that is, they can be opened and closed from either end using bottom sliders 68, 69 and top sliders 70, 71. Double-ended zippers 64, 66 provide several advantages. First, carriers of the prior art are made short at the waist so the wearer can sit down without the carrier digging into the abdomen or pushing downwardly against the duty belt forcing the armor up and choking the wearer. This means that the lower part of the abdomen is exposed when standing. The double-ended zipper allows the carrier cover 10 to be longer to cover more of the wearer's abdomen. When sitting, the bottom sliders 68, 69 can be used to open the bottom of the carrier 10 for comfort when sitting. In addition, the carrier cover 10 can be made looser by opening the zippers 64, 66 and loosening one or both waist straps 86.

The present invention contemplates that other types of removable fasteners can be used to attach the front panel 60 to the rear panel 62 of the carrier cover 10. Examples include hook and look fasteners, snaps, buckles, and hook and eye closures. However, zippers 64, 66 provide a tactical advantage in that they are difficult to remove during an altercation.

Between the rear zipper component 82, 84 and the rear panel 62 is a waist panel 76, 78 that allows for improved ventilation, better fit, and freer motion. Preferably, the waist panels 76, 78 are composed substantially of a stretch fabric. In one configuration, the waist panel 76, 78 is a stretch nylon, double layer, four-way stretch mesh knit. The waist panels 76, 78 help hide the body armor panel carriers 40, 42 and body armor straps 86 outside of the pockets 44, 46, thereby facilitating the illusion of a standard uniform shirt.

To use the carrier cover 10 of the present invention, the carrier cover 10 laid on a flat surface outer layer 17 down. The front armor panel carrier 40 with armor panel installed is folded and slid into one of the front openings 48, 49 and then unfolded and arranged appropriately within the front pocket 44. The rear armor panel carrier 42 with armor panel installed is folded and slid into one of the rear openings 50, 51 and then unfolded and arranged appropriately within the rear pocket 46. The shoulder straps 92 are arranged as necessary through the tunnels 52, 53 via the openings 54, 55 at the shoulder 25.

After the armor panel carriers 40, 42 are installed, the carrier cover 10 is placed over the wearer's head to rest on the shoulders such that the waist panels 76, 78 are at the back of the wearer. The wearer uses the waist straps 86 to attach the armor panel carriers 40, 42 together at the waist. Last, each waist panel 76, 78 is pulled over the waist straps 86 and the zippers 64, 66 are attached, whereby the waist straps 86 are hidden by the waist panels 76, 78.

B. Duty Belt Suspension

Another invention described herein is a system for removably suspending a duty belt, shown in FIGS. 9-31.

The present system is a removable attachment 118 that attaches a duty belt 116 to an outer ballistic vest 102 in order to transfer much of the weight of the belt 116 onto the wearer's shoulders. The attachment 118 includes one or more fasteners 120 that come in two-component and three-component embodiments. One component 122 of the fastener 120 is attached to the vest 102 and the other component 124 of the fastener 120 is attached to the belt 116. If there is more than one fastener 120, they are positioned around the waist to evenly distribute the weight of the belt 116.

A ballistic vest 102 is worn about the torso and hangs from the shoulders. Any type of external carrier vest or carrier cover 102 that hangs from the shoulders is contemplated for use with the present invention, including the carrier cover 10 described above. The term, "vest", in the remainder of the present specification is intended to include any type of external carrier vest or carrier cover that hangs from the shoulders.

A typical vest 102 is comprised of two components, the front panel 104 covering the front of the torso and the rear panel 106 covering the back of the torso. The front and rear panels 104, 106 are joined at the shoulders 108 so that the weight of the vest 102 is carried on the shoulders. The joining can be either temporary, such as by mating hook and loop fasteners 110, as in FIG. 9, or permanent, such as by a strip of fabric 112 extending between the panels 104, 106, as in FIG. 10. Alternatively, one shoulder can be joined by fabric 112 and the other shoulder by a hook and loop fastener 110. Typically, hook and loop fasteners 114 join the front and rear panels 104, 106 at or above the waist on the sides of the torso. Alternatively, the waist fasteners 114 can be zippers or other fasteners, as described above with respect to the ballistic vest carrier cover invention of FIGS. 1-8.

Figure 9:
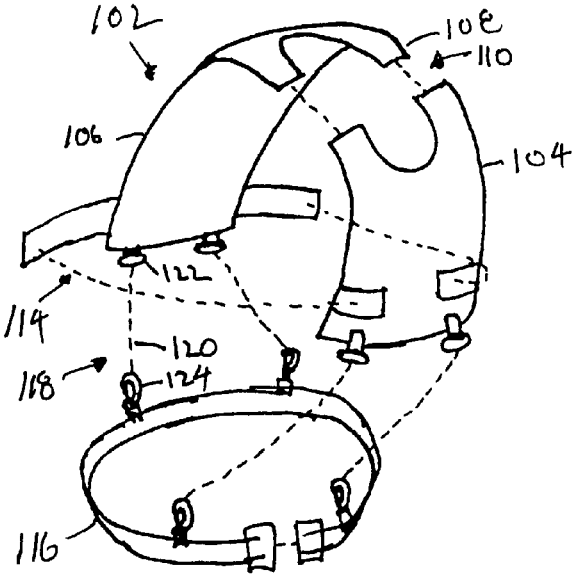
FIG. 9 is a perspective view of one configuration of a duty belt suspension system.
Figure 10:
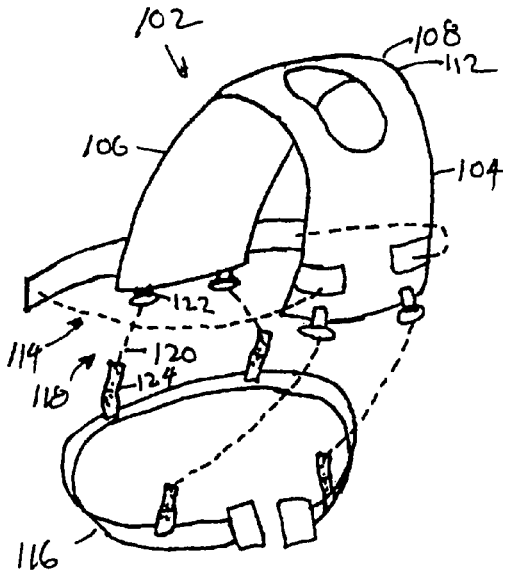
FIG. 10 is a perspective view of another configuration of a duty belt suspension system.
Figure 11:
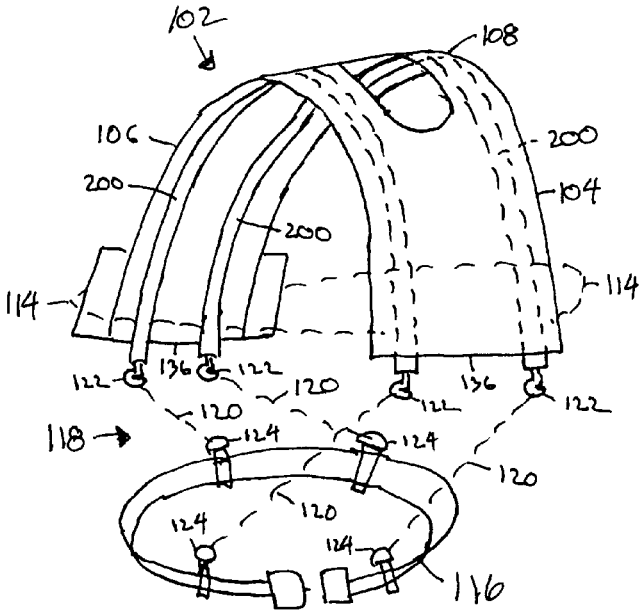
FIG. 11 is a perspective view of another configuration of a duty belt suspension system.
Figure 12:
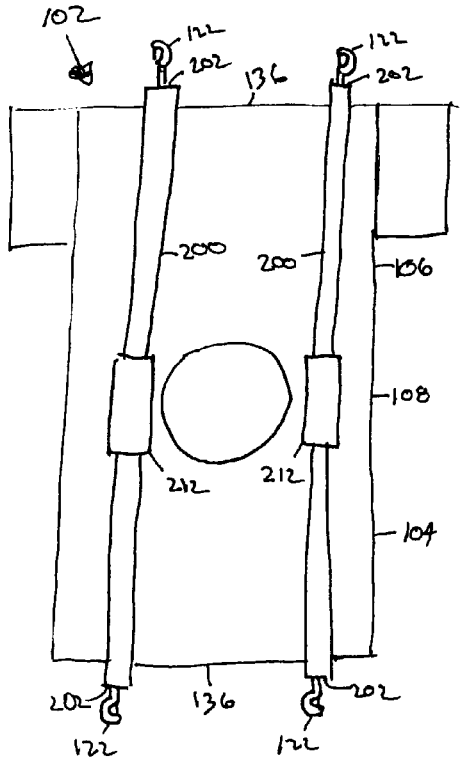
FIG. 12 is a view of the inside of the duty belt suspension system of FIG. 11.

In the embodiment of FIGS. 9 and 10, the vest component 122 of the fastener 120 is attached directly to the vest 102.

In the remaining embodiments, the vest components 122 of the fasteners 120 are attached to the ends of a pair of straps 200. The straps 200 extend up the inside of the front panel 104, over the shoulder 108, to the rear panel 106, as shown in FIGS. 11-16. The straps 200 can be webbing or ribbon, woven or knit, stretch or non-stretch, and composed of nylon, polyester, or blended materials like polyester and cotton. Optionally, the straps 200 are made to have an adjustable length using rings and/or buckles in a manner well-known in the art. Optionally, there are padded reinforcements 212 at the shoulders to provide comfort and to prevent pinching or digging into the shoulder. Optionally, the reinforcements 212 are removable and movable.

The ends 202 of the straps 200 extend to approximately the bottom edges 136 of the front and rear panels 104, 106. In the remainder of the specification, any reference to the bottom edges 136 of the vest 102 is also intended as a reference to the ends 202 of the straps 200.

The present invention contemplates several different methods for holding the straps 200 in place. In one method, the straps 200 are held in place permanently, as in FIGS. 11 and 12. Examples of permanent attachment include sewing the straps 200 into the vest 102 or heat-fusing the straps 200 to the vest 102. Any other method of permanent attachment is contemplated by the present invention.

Figure 13:
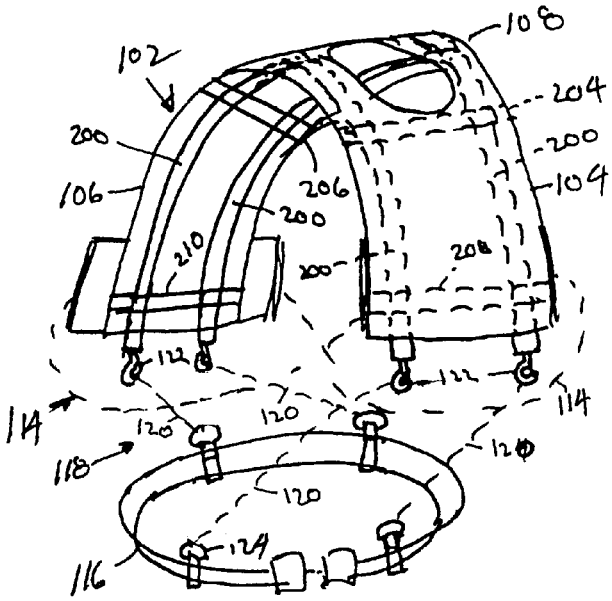
FIG. 13 is a perspective view of another configuration of a duty belt suspension system.
Figure 14:
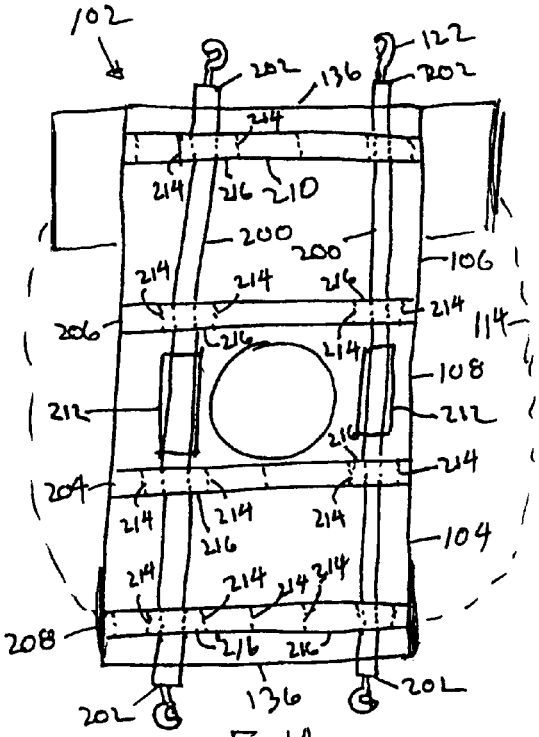
FIG. 14 is a view of the inside of the duty belt suspension system of FIG. 13.

In another method, the straps 200 held in place by bands, as in FIGS. 13 and 14. An upper front band 204 extends horizontally across the front panel 104 of the vest 102 below the shoulder 108 and an upper rear band 206 extends horizontally across the rear panel 106 of the vest 102 below the shoulder 108. A lower front band 208 extends horizontally across the front panel 104 of the vest 102 above the bottom edge 136 and a lower rear band 210 extends horizontally across the rear panel 106 of the vest 102 above the bottom edge 136. Lines of sewn thread 214 produce slots 216 that the straps 200 extend through. The slots 216 are large enough that the straps 200 can move freely. Optionally, there can be several lines of thread 214 that produce adjacent slots 216 so that the straps 200 can be moved horizontally to different slots 216 in order to customize the fit.

Figure 15:
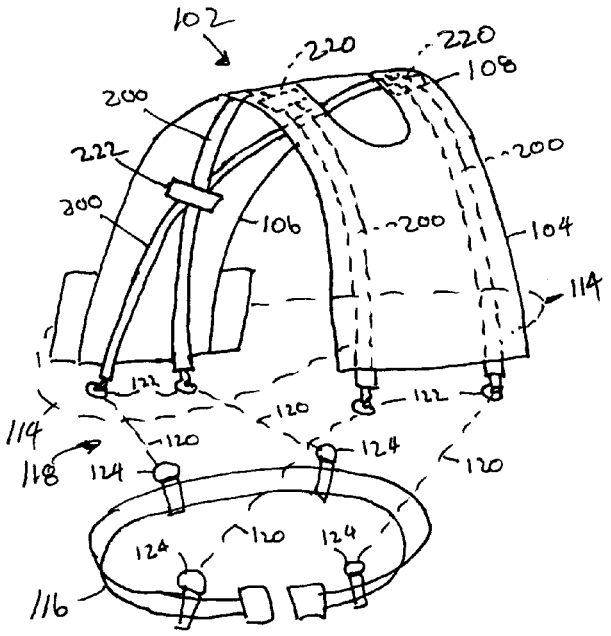
FIG. 15 is a perspective view of another configuration of a duty belt suspension system.
Figure 16:
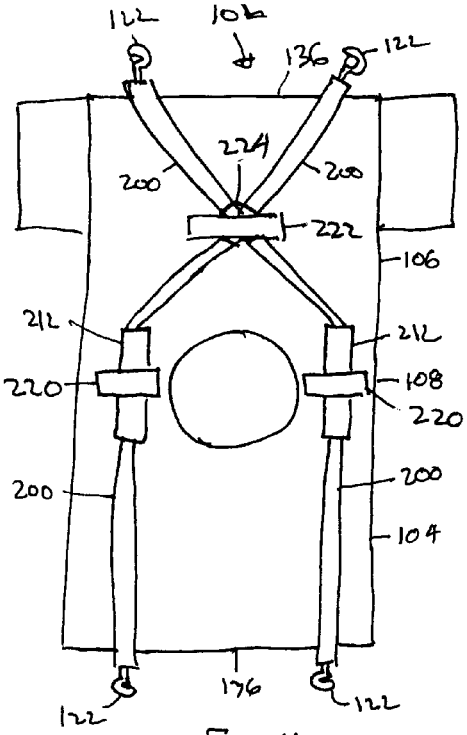
FIG. 16 is a view of the inside of the duty belt suspension system of FIG. 15.

In another method, the straps 200 are held in place by a different configuration of bands, as in FIGS. 15 and 16. The straps 200 extend through a pair of horizontal bands 220 at the shoulders. Optionally, the bands 220 are wide enough so that the shoulder pads 212 fit through the bands 220. The straps 200 extend down the front panel 103 parallel to each other. The straps 200 extend down the rear panel 106, crossing in the center. The straps 200 extend through a short horizontal band 222 located generally centrally on the rear panel 106. Optionally, the bands 200 are attached together where they cross by an attachment device 224.

The duty belt is typically constructed of leather or nylon and supports heavy gear such as a pistol, extra ammunition, radio, handcuffs, flashlight, and baton. The belt is secured about the waist using metal or plastic buckles and keepers, or straps made from leather, synthetic leather, nylon or polyester. Keepers secure the duty belt to the base or keeper belt, which hold up the uniform pants. In another configuration, the two belts are secured to each other using hook and loop in place of keepers.

Figure 17:
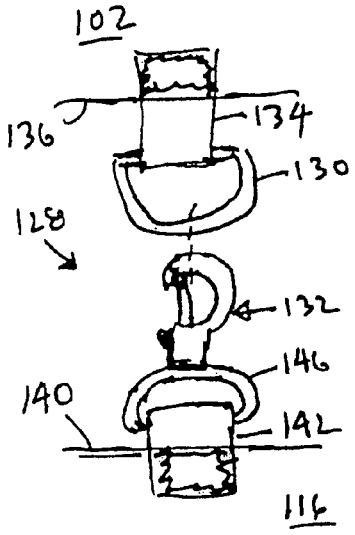
FIG. 17 is a detailed view of several configurations of the ring/clip embodiment of the vest/belt attachment.
Figure 18:
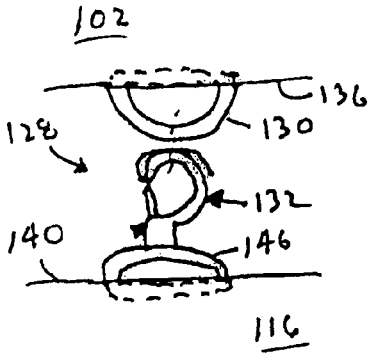
FIG. 18 is a detailed view of other configurations of the ring/clip embodiment.
Figure 19:
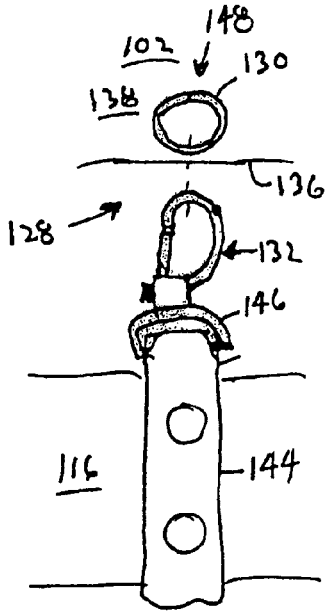
FIG. 19 is a detailed view of other configurations of the ring/clip embodiment.

In one embodiment, shown in FIGS. 17-19, the vest/belt attachment 118 includes one or more ring/spring clip combinations 128. Each combination 128 includes a ring 130 at the bottom of the vest 102 and a clip 132 at the top of the belt 116.

The ring 130 comes in several configurations. In one configuration, shown in FIG. 17, the ring 130 hangs from a loop 134 that extends from the bottom edge 136 of the vest 102. The loop 134 can be a constructed of a flexible material that is typically the same as the outer shell of the vest 102 or the strap 200, such as nylon. The ring 130 can be any shape, such as round or D-shaped, as in FIG. 17. The ring 130 is composed of a strong, rigid material, such as steel, hard plastic, or carbon composite.

In another configuration, shown in FIG. 18, the ring 130 is sewn or otherwise integrated into the bottom edge 136 of the vest 102. In yet another configuration, shown in FIG. 19, the ring 130 is integrated into the fabric 138 of the vest 102, as at 148, near the bottom edge 136. In this configuration, the ring 130 is not necessarily a rigid material. It can be merely an opening with a reinforced perimeter, similar to a button hole or eyelet. The present invention contemplates that any method of attaching the ring 130 to the bottom edge 136 of the vest 102 can be used.

The spring clip 132 extends from the top edge 140 of the belt 116. In one configuration, shown in FIG. 17, the ring 146 of the clip 132 attaches to the belt 116 by a loop 142 that extends from the top edge 140 of the belt 116. The loop 142 can be a constructed of a flexible material that can be the same as the belt 116, such as nylon or leather. The clip ring 146 is composed of a strong, rigid material, such as steel, hard plastic, or carbon composite.

In another configuration, shown in FIG. 18, the clip ring 146 is sewn or otherwise integrated into the top edge 140 of the belt 116. The present invention contemplates that any method of attaching the clip 132 to the top edge 140 of the belt 116 can be used.

In another configuration, shown in FIG. 19, the clip 132 is on a loop 144 that fits onto the belt 116. The loop 144 can extend loosely through the clip ring 146, as in FIG. 19, or the clip ring 146 can be sewn or otherwise integrated into the loop 144. The loop 114 slides onto the belt 116. The loop 144 can be a constructed of a flexible material that can be the same as the belt 116, such as nylon or leather.

Figure 20:
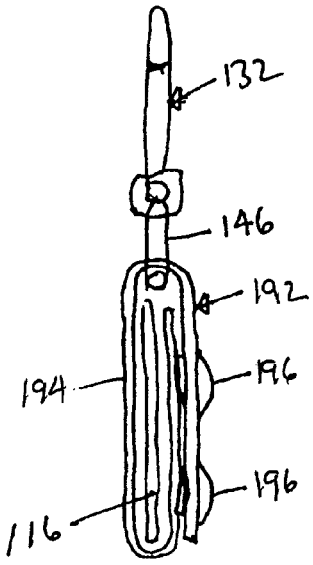
FIG. 20 is a detailed side view of other configurations of the ring/clip embodiment.

In another configuration, shown in FIG. 20, the clip 132 is on a duty belt keeper 192. The duty belt keeper 192 is a strip 194 of material with a pair of heavy-duty snaps 196. The keeper 192 can extend loosely through the clip ring 146, as in FIG. 20, or the clip ring 146 can be sewn or otherwise integrated into the keeper 192. The keeper 192 is wrapped around the duty belt 116, as in FIG. 20, or around the duty belt 116 and a trouser/keeper belt and the snaps 196 are engaged. The keeper 192 can be a constructed of a flexible material that can be the same as the belt 116, such as nylon or leather.

Alternatively, the locations of the clip 132 and the ring 130 can be reversed, that is, the clip 132 is attached to the vest 102 and the ring 130 is attached to the belt 116.

To fasten the belt 116 to the vest 102, each clip 132 is clipped onto the adjacent ring 130.

Figure 21:
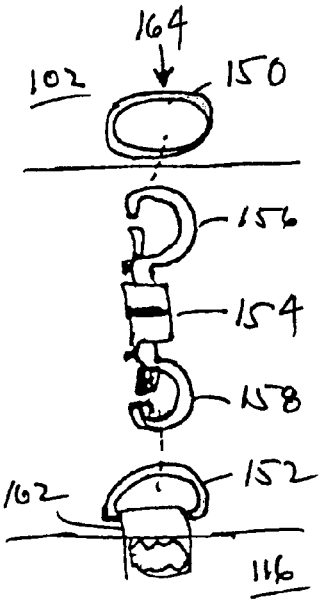
FIG. 21 is a detailed view of the dual clip embodiment of the vest/belt attachment.
Figure 22:
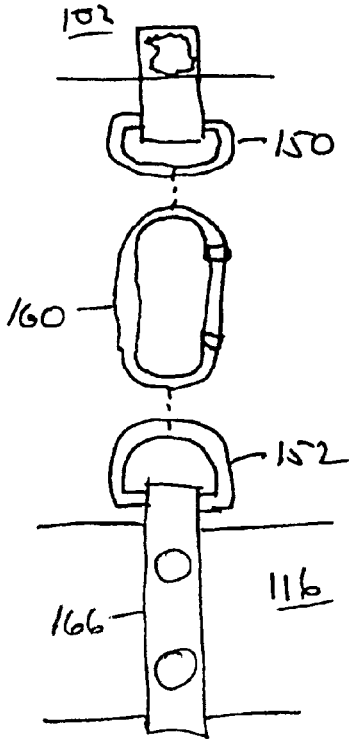
FIG. 22 is a detailed view of other configurations of the dual clip embodiment.

In another embodiment of the vest/belt attachment 118, shown in FIGS. 21 and 22, the vest 102 and belt 116 both have rings 150, 152. The rings 150, 152 can be any configuration of the ring described above with reference to the embodiment of FIGS. 17-20, including a ring on an attached loop 162, an integrated ring 164, and a ring on a loop 166 that slides onto the belt 116, and a ring on a keeper. The vest ring 150 can be a different configuration from that of the belt ring 152.

The vest 102 and belt 116 are attached by a double-ended clip 154, that is, a device with a clip 156, 158 at each end, as in FIG. 21. Alternatively, as shown in FIG. 22, a carabiner 160 can be used in place of a double-ended clip 154.

To fasten the belt 116 to the vest 102, one clip 156 of the double-ended clip 154 is clipped onto one ring 150 and the other clip 158 of the double-ended clip 154 is clipped onto the adjacent ring 152.

Figure 23:
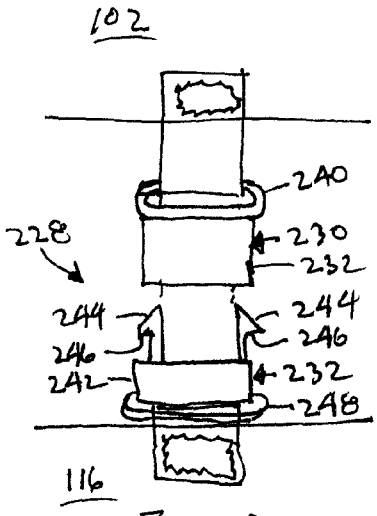
FIG. 23 is a front view of a side release buckle attachment.
Figure 24:
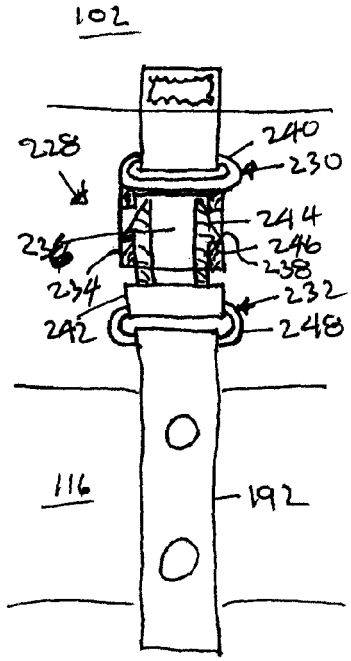
FIG. 24 is a partial cross-sectional view of the side release buckle attachment of FIG. 24 connected.

In another embodiment, shown in FIGS. 23 and 24, the vest/belt attachment 118 includes one or more side release buckles 228. Each buckle 228 includes a female component 230 at the bottom of the vest 102 or on the strap 200 and a male component 232 at the top of the belt 116. Alternatively, the female component 230 and male component 232 can be reversed wherein the male component 232 is on the vest 102 or strap 200 and the female component 230 is on the belt 116.

In a side release buckle, a pair of opposed arms 244 extend from the male component body 242. The arms 244 fit into a slot 236 in the female component body 234. As the arms 244 move into the slot 236, the arms 244 bend inwardly toward each other. When shoulders 246 in the arms 244 reach ledges 238 in the sides of the slot 236, the arms 244 snap back away from each other, whereby the shoulders 246 engage the ledges 238, preventing the male component 232 from being pulled from the female component 230. To release the buckle 228, the arms 244 are manually pressed together to disengage the shoulders 246 from the ledges 238, and the male component 232 is pulled from the female component 230.

The buckle components 230, 232 can be attached to the vest 102 or strap 200 and belt 116 in any manner described above with reference to the rings of the embodiments of FIGS. 17-22, including a ring 240 on an attached loop, integrated with the vest 102 or belt 116, a ring 248 on a loop that slides onto the belt 116, and a ring 248 on a keeper 192.

Figure 25:
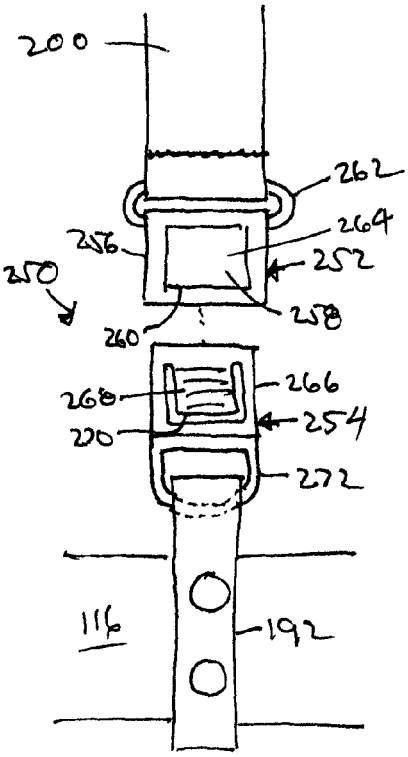
FIG. 25 is a front view of a front release buckle attachment.
Figure 26:
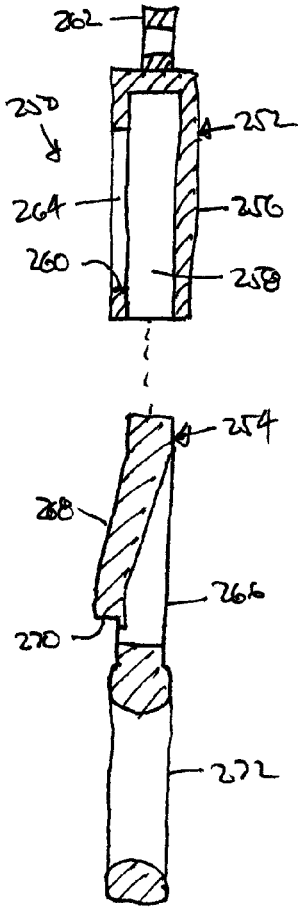
FIG. 26 is an enlarged, cross-sectional view of the front release buckle of FIG. 25 with components disengaged.
Figure 27:
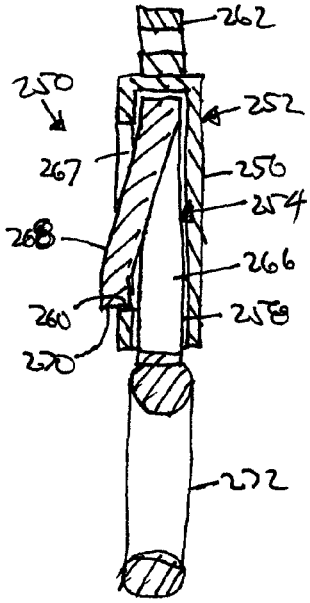
FIG. 27 is an enlarged, cross-sectional view of the front release buckle of FIG. 25 with components engaged.

In another embodiment, shown in FIGS. 25-27, the vest/belt attachment 118 includes one or more front release buckles 250. Each buckle 250 includes a female component 252 at the bottom of the vest 102 or on the strap 200 and a male component 254 at the top of the belt 116. Alternatively, the female component 252 and male component 254 can be reversed wherein the male component 254 is on the vest 102 or strap 200 and the female component 252 is on the belt 116.

In the front release buckle, a wide finger 268 extends outwardly from the male component body 266. The male component body 266 fits into a slot 258 in the female component body 256. As the finger 268 moves into the slot 258, the finger 268 bends inwardly. When the end 270 of the finger 268 reaches the bottom ledge 260 of a window 264 in the side of the slot 258, the finger 268 snaps back to its normal position, whereby the finger end 270 engages the window ledge 260, preventing the male component 254 from being pulled from the female component 252. To release the buckle 250, the finger 268 is manually pressed into the window 264 to disengage the finger end 270 from the ledge 260, and the male component 254 is pulled from the female component 252.

The buckle components 252, 254 can be attached to the vest 102 or strap 200 and belt 116 in any manner described above with reference to the rings of the embodiments of FIGS. 17-22, including a ring 262 on an attached loop, integrated with the vest 102 or strap 200, and a ring 272 on a loop that slides onto the belt 116, and a ring 262 on a keeper 192. Optionally, the ring 272 attached to the loop or keeper 192 can be a D-ring. This permits the loop or keeper 192 to pivot on the ring 262. This is particularly advantageous when using the crossing straps 200 of the embodiment of FIGS. 15 and 16.

Figure 28:
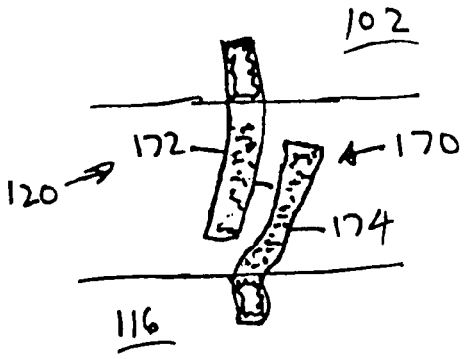
FIG. 28 is a detailed view of the mating hook and loop embodiment of the vest/belt attachment.

In another embodiment of the fastener 120, shown in FIG. 28, the vest 102 has one component 172 of a hook-and-loop fastener 170 and the belt 116 has the other component 174 of the hook-and-loop fastener 170. The components 172, 174 extend from the vest 102 and belt 116 as strips, as is well-known in the industry.

To fasten the belt 116 to the vest 102, corresponding hook and loop components 172, 174 are mated.

Figure 29:
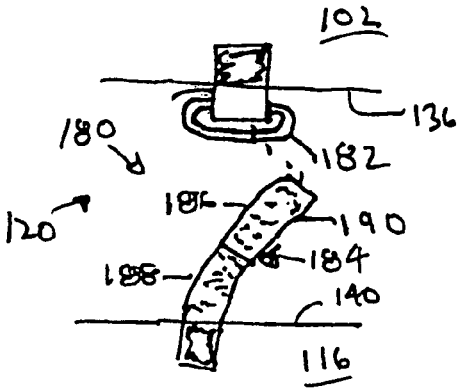
FIG. 29 is a detailed view of several configurations of the ring/hook and loop embodiment of the vest/belt attachment.
Figure 30:
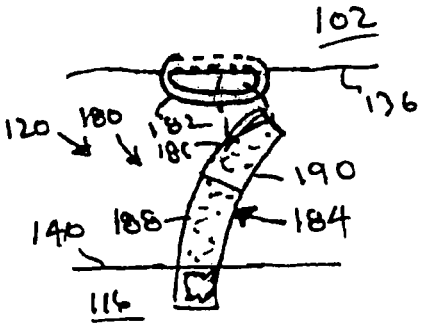
FIG. 30 is a detailed view of other configurations of the ring/hook and loop embodiment.
Figure 31:
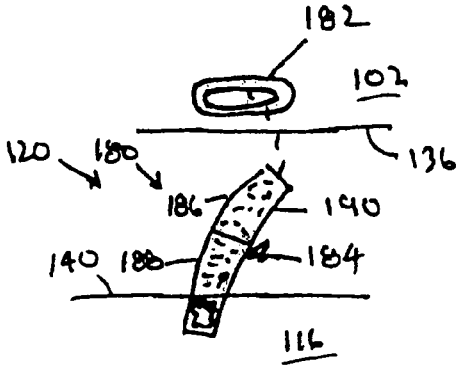
FIG. 31 is a detailed view of other configurations of the ring/hook and loop embodiment.

In another embodiment, shown in FIGS. 29-31, the fastener 120 is a ring/hook-and-loop strip combination 180. Each combination includes a ring 182 at the bottom 136 of the vest 102 and a hook-and-loop strip 184 at the top 140 of the belt 116.

The ring 182 can come in any of the configurations described above with reference to the embodiments of FIGS. 17-22.

A hook-and-loop strip 184 as envisioned by the present invention is a ribbon 190 of material that extends from the top 140 of the belt 116. It is sewn or otherwise attached to the belt 116. The ribbon 190 has the hook component 186 at one end and the loop component 188 at the other end on the same side of the ribbon 190. When the strip 184 is folded over, the hook component 186 mates with the loop component 188.

Alternatively, the strip 184 extends from the bottom edge 136 of the vest 102 and the ring 182 is at the top edge 140 of the belt 116.

To fasten the belt 116 to the vest 102, the hook-and-loop strip 184 is threaded through the corresponding ring 182 and folded over until the hook component 186 of the strip 184 mates with the loop component 188 of the strip 184.

Since certain changes may be made in the present disclosure without departing from the scope of the present inventions, it is intended that all matter described in the foregoing specification and shown in the accompanying drawings be interpreted as illustrative and not in a limiting sense.

What is claimed is:

1. A cover for a ballistic vest carrier, said carrier including a front armor panel in a front portion of the carrier, a rear armor panel in a rear portion of the carrier, attachable/detachable waist fasteners for removably attaching said front portion of the carrier to said rear portion of the carrier at the waist of a wearer, and attachable/detachable shoulder fasteners for removably attaching said front portion of the carrier to said rear portion of the carrier at the shoulders of the wearer, said cover comprising:

(a) a mantle extending from a front waist of the mantle through shoulders of the mantle to a rear waist of the mantle and having a neck opening, a right side, and a left side, said mantle having an outer fabric layer and a liner, said liner being attached to said outer layer at the front waist at a front waist attachment, at the rear waist at a rear waist attachment, at the neck opening, along the right side from a right front armor opening on the right side adjacent to the front waist to a right rear armor opening on the right side adjacent to the rear waist, and along the left side from a left front armor opening on the left side adjacent to the front waist to a left rear armor opening on the left side adjacent to the rear waist, thereby forming a front pocket and a rear pocket between said outer layer and said liner, the right front armor opening being separated from the left front armor opening by the front waist attachment, the right rear armor opening being separated from the left rear armor opening by the rear waist attachment, said front pocket being connected to said rear pocket by tunnels between said outer layer and said liner at the shoulders, said front pocket being accessible through said right and left front armor openings and said rear pocket being accessible through said right and left rear armor openings;

(b) a right waist panel extending from said outer fabric layer at said right rear armor opening to a free end;

(c) a left waist panel extending from said outer fabric layer at said left rear armor opening to a free end;

(d) a right zipper having a right rear zipper component attached to said right waist panel free end and a mating right front zipper component attached to said outer fabric layer at said right front armor opening; and (e) a left zipper having a left rear zipper component attached to said left waist panel free end and a mating left front zipper component attached to said outer fabric layer at said left front armor opening;

(f) whereby said front portion of the carrier is installed in said front pocket through one of said right and left front armor openings, said rear portion of the carrier is installed in said rear pocket through one of said right and left rear armor openings, said front portion of the carrier is attached to said rear portion of the carrier by said shoulder fasteners through said tunnels and by said waist fasteners at the waist, said waist panels are extended over said waist fasteners, and said zippers are attached.

2. The ballistic carrier cover of claim 1 wherein said mantle is composed of a single panel.

3. The ballistic carrier cover of claim 1 wherein said mantle is composed of a front panel and a back panel attached at the shoulders.

4. The ballistic carrier cover of claim 1 wherein said outer layer includes one or more of the following: breast pockets, a false placket with buttons, a shoulder yoke, shoulder epaulets, front and/or rear creases, a microphone tab; and a tie clip strip.

5. The ballistic carrier cover of claim 1 wherein said outer layer includes an interlining attached to said outer layer between said outer layer and said liner.

6. The ballistic carrier cover of claim 5 wherein said interlining is attached to said outer layer by a thermoplastic adhesive.

7. The ballistic carrier cover of claim 1 wherein said liner is composed in part of a mesh fabric.

8. The ballistic carrier cover of claim 1 wherein said liner has openings at the shoulders to provide access to said tunnels.

9. The ballistic carrier cover of claim 1 wherein said waist panels are composed substantially of a stretch fabric.

10. The ballistic carrier cover of claim 1 wherein said zippers are double-ended.

11. A cover for a ballistic vest carrier, said carrier including a front armor panel in a front portion of the carrier, a rear armor panel in a rear portion of the carrier, attachable/detachable waist fasteners for removably attaching said front portion of the carrier to said rear portion of the carrier at the waist of a wearer, and attachable/detachable shoulder fasteners for removably attaching said front portion of the carrier to said rear portion of the carrier at the shoulders of the wearer, said cover comprising:

(a) a mantle extending from a front waist of the mantle through shoulders of the mantle to a rear waist of the mantle and having a neck opening, a right side, and a left side, said mantle having an outer fabric layer and a liner, said outer layer including an interlining attached to said outer layer between said outer layer and said liner by a thermoplastic adhesive, said liner being attached to said outer layer at the front waist at a front waist attachment, at the rear waist at a rear waist attachment, at the neck opening, along the right side from a right front armor opening on the right side adjacent to the front waist to a right rear armor opening on the right side adjacent to the rear waist, and along the left side from a left front armor opening on the left side adjacent to the front waist to a left rear armor opening on the left side adjacent to the rear waist, thereby forming a front pocket and a rear pocket between said outer layer and said liner, the right front armor opening being separated from the left front armor opening by the front waist attachment, the right rear armor opening being separated from the left rear armor opening by the rear waist attachment, said front pocket being connected to said rear pocket by tunnels between said outer layer and said liner at the shoulders, said tunnels being accessible through openings in said liner at the shoulders, said front pocket being accessible through said right and left front armor openings and said rear pocket being accessible through said right and left rear armor openings;

(b) a right waist panel composed substantially of a stretch fabric extending from said outer fabric layer at said right rear armor opening to a free end;

(c) a left waist panel composed substantially of a stretch fabric extending from said outer fabric layer at said left rear armor opening to a free end;

(d) a right zipper having a right rear zipper component attached to said right waist panel free end and a mating right front zipper component attached to said outer fabric layer at said right front armor opening; and (e) a left zipper having a left rear zipper component attached to said left waist panel free end and a mating left front zipper component attached to said outer fabric layer at said left front armor opening;

(f) whereby said front portion of the carrier is installed in said front pocket through one of said right and left front armor openings, said rear portion of the carrier is installed in said rear pocket through one of said right and left rear armor openings, said front portion of the carrier is attached to said rear portion of the carrier by said shoulder fasteners through said tunnels and by said waist fasteners at the waist, said waist panels are extended over said waist fasteners, and said zippers are attached.

12. The ballistic carrier cover of claim 11 wherein said mantle is composed of a single panel.

13. The ballistic carrier cover of claim 11 wherein said mantle is composed of a front panel and a back panel attached at the shoulders.

14. The ballistic carrier cover of claim 11 wherein said outer layer includes one or more of the following: breast pockets, a false placket with buttons, a shoulder yoke, shoulder epaulets, front and/or rear creases, a microphone tab; and a tie clip strip.

15. The ballistic carrier cover of claim 11 wherein said liner is composed in part of a mesh fabric.

16. The ballistic carrier cover of claim 11 wherein said zippers are double-ended.

17. A ballistic vest carrier and cover assemblage comprising:

(a) a mantle extending from a front waist of the mantle through shoulders of the mantle to a rear waist of the mantle and having a neck opening, a right side, and a left side, said mantle having an outer fabric layer and a liner, said liner being attached to said outer layer at the front waist at a front waist attachment, at the rear waist at a rear waist attachment, at the neck opening, along the right side from a right front armor opening on the right side adjacent to the front waist to a right rear armor opening on the right side adjacent to the rear waist, and along the left side from a left front armor opening on the left side adjacent to the front waist to a left rear armor opening on the left side adjacent to the rear waist, thereby forming a front pocket and a rear pocket between said outer layer and said liner, the right front armor opening being separated from the left front armor opening by the front waist attachment, the right rear armor opening being separated from the left rear armor opening by the rear waist attachment, said front pocket being connected to said rear pocket by tunnels between said outer layer and said liner at the shoulders, said front pocket being accessible through said right and left front armor openings and said rear pocket being accessible through said right and left rear armor openings;

(b) a front armor panel in a front portion of the carrier and installed in the front pocket;

(c) a rear armor panel in a rear portion of the carrier and installed in the rear pocket;

(d) a right attachable/detachable waist fastener removably attaching said front portion of the carrier to said rear portion of the carrier at the waist;

(e) a left attachable/detachable waist fastener removably attaching said front portion of the carrier to said rear portion of the carrier at the waist;

(f) attachable/detachable shoulder fasteners extending through the tunnels and removably attaching the front portion of the carrier to the rear portion of the carrier;

(g) a right waist panel extending over the right attachable/detachable waist fastener from said outer fabric layer at said right rear armor opening to a free end;

(h) a left waist panel extending over the left attachable/detachable waist fastener from said outer fabric layer at said left rear armor opening to a free end;

(i) a right zipper having a right rear zipper component attached to said right waist panel free end and a mating right front zipper component attached to said outer fabric layer at said right front armor opening; and (j) a left zipper having a left rear zipper component attached to said left waist panel free end and a mating left front zipper component attached to said outer fabric layer at said left front armor opening.

18. The assemblage of claim 17 wherein the outer layer includes one or more of the following: breast pockets, a false placket with buttons, a shoulder yoke, shoulder epaulets, front and/or rear creases, a microphone tab; and a tie clip strip.

19. The assemblage of claim 17 wherein the outer layer includes an interlining attached to the outer layer between the outer layer and the liner.

20. The assemblage of claim 17 wherein the liner is composed in part of a mesh fabric.

21. The assemblage of claim 17 wherein the liner has openings at the shoulders to provide access to the tunnels.

* * * * *